US007455291B2

(12) United States Patent
Reeves et al.

(10) Patent No.: US 7,455,291 B2
(45) Date of Patent: Nov. 25, 2008

(54) MEDIA ALIGNMENT SYSTEMS AND METHODS

(75) Inventors: Robert James Douglas Reeves, Toronto (CA); Martyn Mitchell, Milton (CA); Michael John Gregg, Port Hope (CA); Waleed Nasar, Thornhill (CA)

(73) Assignee: Xerox Corporation, Norwalk, CT (US)

( * ) Notice: Subject to any disclaimer, the term of this patent is extended or adjusted under 35 U.S.C. 154(b) by 374 days.

(21) Appl. No.: 11/316,224

(22) Filed: Dec. 22, 2005

(65) Prior Publication Data

US 2007/0145665 A1 Jun. 28, 2007

(51) Int. Cl.
*B65H 29/44* (2006.01)

(52) U.S. Cl. ..... 271/181; 271/221

(58) Field of Classification Search ..... 271/220, 271/221, 181

See application file for complete search history.

(56) References Cited

U.S. PATENT DOCUMENTS 3,934,735 A * 1/1976 Schmidt ..... 414/798.9
4,230,312 A * 10/1980 Templeton ..... 271/215
4,651,934 A * 3/1987 Bender et al. ..... 241/36
5,094,660 A * 3/1992 Okuzawa ..... 493/320
5,172,905 A * 12/1992 Vanous et al. ..... 271/209
5,199,700 A * 4/1993 Fairey et al. ..... 271/209
5,207,417 A * 5/1993 Bell et al. ..... 271/175
5,228,679 A * 7/1993 Borostyan ..... 271/213
5,516,092 A * 5/1996 Pollich ..... 271/221
5,772,201 A * 6/1998 Shinozuka ..... 271/220
6,032,004 A 2/2000 Mirabella, Jr. et al.
6,065,746 A * 5/2000 Tranquilla ..... 271/176
6,145,825 A * 11/2000 Kunihiro et al. ..... 270/58.09
6,793,113 B2 9/2004 Chakraborty et al.
2004/0032073 A1 2/2004 Sasamoto
2005/0225021 A1 10/2005 Yamada et al.

* cited by examiner

*Primary Examiner*—Kaitlin S Joerger
(74) *Attorney, Agent, or Firm*—Gibb & Rahman, LLC

(57) ABSTRACT

Embodiment herein being by placing a media sheet into a chamber. The chamber has a bottom, sidewalls, and a movable projection within a lower portion of the chamber. The movable projection has an upper surface and the media sheet can initially rest on the upper surface of the movable projection. The method can optionally perform a first alignment process (using an alignment mechanism) while the media sheet rests on the upper surface of the movable projection. Then, the method can retract the movable projection to allow the media sheet to fall onto the bottom of the chamber. Next, once the media sheet rests against the bottom of the chamber, the method performs a second alignment process, again using the alignment mechanism.

20 Claims, 6 Drawing Sheets

MEDIA ALIGNMENT SYSTEMS AND METHODS

BACKGROUND

Embodiments herein generally relate to post-printing finishing and alignment processes and systems.

It is useful to align media sheets (sheets of paper, transparencies, card stock, or any other form of stackable media) once they are output from an apparatus that processes multiple sheets, such as a printer, fax machine, multi-function device, image output terminal, etc. Once the media sheets are aligned, they can more easily be subjected to finishing processes, such as binding, stapling, perforating, bonding, etc.

SUMMARY

One exemplary method embodiment herein beings by placing a media sheet into a chamber. The chamber has a bottom, sidewalls, and a movable projection within a lower portion of the chamber. The movable projection has an upper surface and the media sheet can initially rest on the upper surface of the movable projection. The method can optionally perform a first tamping alignment process (using an alignment mechanism) while the media sheet rests on the upper surface of the movable projection. Then, the method can retract the movable projection to allow the media sheet to fall onto (rest against) the bottom of the chamber. Next, once the media sheet rests against the bottom of the chamber, the method performs a second tamping alignment process, again using the alignment mechanism.

Another feature of the method is that embodiments herein can extend the movable projection toward the media sheets such that the front surface of the movable projection (that is approximately perpendicular to the upper surface of the movable projection) applies pressure to a full width (or specific points along the width) of a lower portion of the media sheets. The movable projection has a width approximately at least as wide as the media sheet, and, therefore, the pressure is applied to substantially the full width of the lower portion of the media sheets. This prevents the media sheets from sagging within the chamber.

The pressure of the movable projection against the lower portion of the media sheets causes flat sides of the media sheets to lie flatter against one of the sidewalls when compared to a position of the sheets with respect to the sidewalls without the pressure. These alignment processes are repeated for additional media sheets sequentially placed into the chamber to maintain proper alignment of all the sheets within the chamber. Then, the properly aligned sheets can be bound, perforated, stapled, or otherwise subjected to post-printing finishing processes.

During the first alignment process and the second alignment process, the alignment mechanism operates between the sidewalls and contacts edges of the media sheets to align a stack of the media sheets within the chamber. During the second alignment process, the method can move the bottom of the chamber toward the top of the chamber so as to move the bottom edge of the media sheets to at least a height of the upper surface of the movable projection. This allows the alignment mechanism to place pressure against the same portions (it is better to tamp closer to the bottom of the set than typical bookletmaker geometry allows) of the media sheets both when the media rests on the movable projection and when the media rests on the bottom of the chamber, and thereby does not require alteration of standard alignment mechanisms.

One example of an apparatus useful with embodiments herein comprises a printing device adjacent the chamber. The printing device is adapted to output the media sheets into the chamber. For example, the printing device comprises at least one of an electrostatographic and a xerographic machine.

The chamber itself has a bottom and sidewalls and, as alluded to above, is adapted to hold media sheets. The alignment mechanism is above the bottom of the chamber and aligns the media sheets within the chamber. The alignment mechanism operates between the sidewalls and is adapted to contact edges of the media sheets to align a stack of the media sheets within the chamber.

The movable projection is also within a lower portion of the chamber. As explained above, the movable projection is adapted to apply pressure to a lower portion of the media sheets. In some embodiments, the movable projection has a width approximately at least as wide as the media sheets. The movable projection comprises a front surface adapted to apply pressure to a lower portion of the media sheets. The front surface of the movable projection has a width approximately at least as wide as the media sheets. The movable projection also comprises an upper surface approximately perpendicular to the front surface. The upper surface is adapted to support at least a first media sheet of the media sheets at a height above the bottom of the chamber to allow the alignment mechanism to align the first media sheet with other media sheets in the chamber.

As explained above, in some embodiments, the bottom of the chamber is adapted to move toward a top of the chamber so as to move the bottom edge of the media sheets to at least a height of the upper surface of the movable projection. Again, when the movable projection applies the pressure to the lower portion of the media sheets, the pressure causes flat sides of the media sheets to lie flatter against one of the sidewalls when compared to a position of the sheets with respect to the sidewalls without the pressure.

By utilizing the full-width movable projection to reduce the amount of sag within the compile chamber, the embodiments herein allow the media sheets to be more easily aligned by the tamping alignment mechanism. Further, by utilizing a two-step alignment process, the tamping alignment mechanism is provided the opportunity to both individually align a newly added sheet with the previously aligned sheets and to subsequently align all sheets within the compile chamber. Thus, this two-step alignment process greatly increases the ability of the alignment device to properly align the media sheets. These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

As mentioned above, it is advantageous to align media sheets to allow efficient finishing processes. One type of device used to align sheets places the media sheets within a chamber and then uses an alignment mechanism to tamp the sheets into alignment with one another. The tamping process places pressure against the side edges of the media sheets (and/or vibrates, etc. against the side edges of the media sheets) to place the media sheets in alignment with one another. For example, U.S. Patent Publications 2004/0032073, 2005/0225021 and U.S. Pat. No. 6,793,113 the complete disclosures of which are incorporated herein by reference, disclose an alignment chamber within a printing apparatus.

Figure 1A:
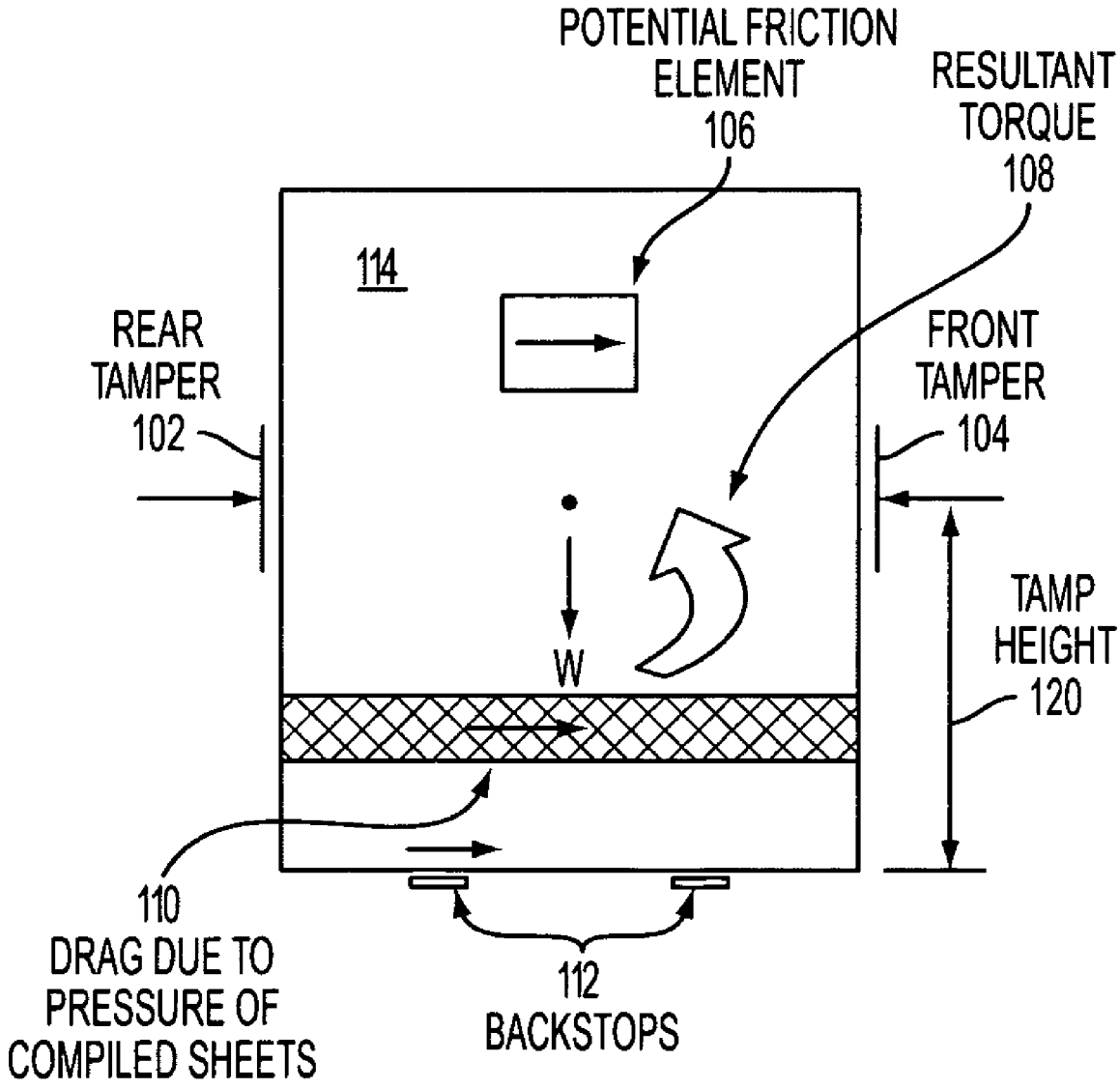
FIG. 1A is a schematic representation of the forces acting on a sheet of media.
Figure 1B:
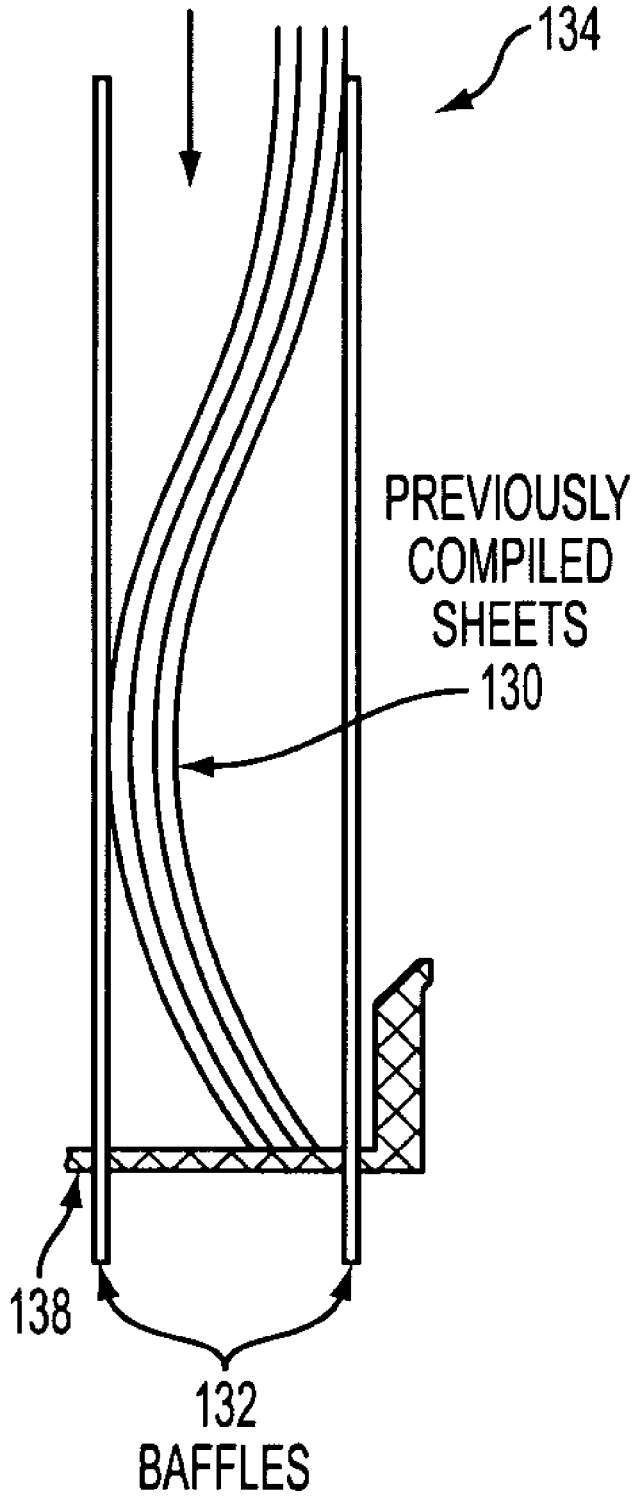
FIG. 1B is a schematic side view representation of a compile chamber.

One issue that occurs when tamping the media sheets into alignment with one another is that sag can occur within the chamber if the chamber is not horizontal, as shown in FIG. 1B. Many times the chamber is vertical or lies at an angle to horizontal. For example, FIG. 1A illustrates a sheet 114 and tampers 102, 104 applying force to the edges of the sheet 114 at a tamp height 120 above backstops (which form part of a bottom 138 of a chamber 134). FIG. 1B illustrates many sheets 130 within the compile chamber 134 made up of baffles 132 and the bottom 138. The resultant torque 108 occurs from the frictional forces where the sheets 130 sag against one of the front baffles 132 (shown as the drag force due to the pressure of the compiled sheets 110 in FIG. 1A). This effect is also illustrated as the potential friction moment 106. The force associated with the weight of the media sheet is shown as item 116. Because of these (and other) frictional forces between the sheets 130, the tampers 102, 104 may not be able to completely align the side edges of the sheets 130.

Indeed, conventional alignment devices often have difficulty achieving good in-set registration (edge alignment), especially with large paper sizes. The mis-alignment is due to the induced moment 106 on each sheet as it is tamped into position. This moment is caused by the friction force of the paper pushing against the baffles 110 due to the sag of the set 130 in the vertical compile chamber 134 and also the lead edge curl. Lead edge curl can also force the lead edge of the tamped sheet to wedge under the previously compiled stack. When the tamper 102, 104 attempts to slide each sheet across, the sheet can pivot from the resulting torque 108 on the one corner and get twisted, causing a fan-like effect on the set 130. The problem is typical of vertical booklet makers due to the architecture constraints which prevent the tampers from being close to the backstop 112. The problem gets worse with thicker sets as the friction force increases.

Figure 2:
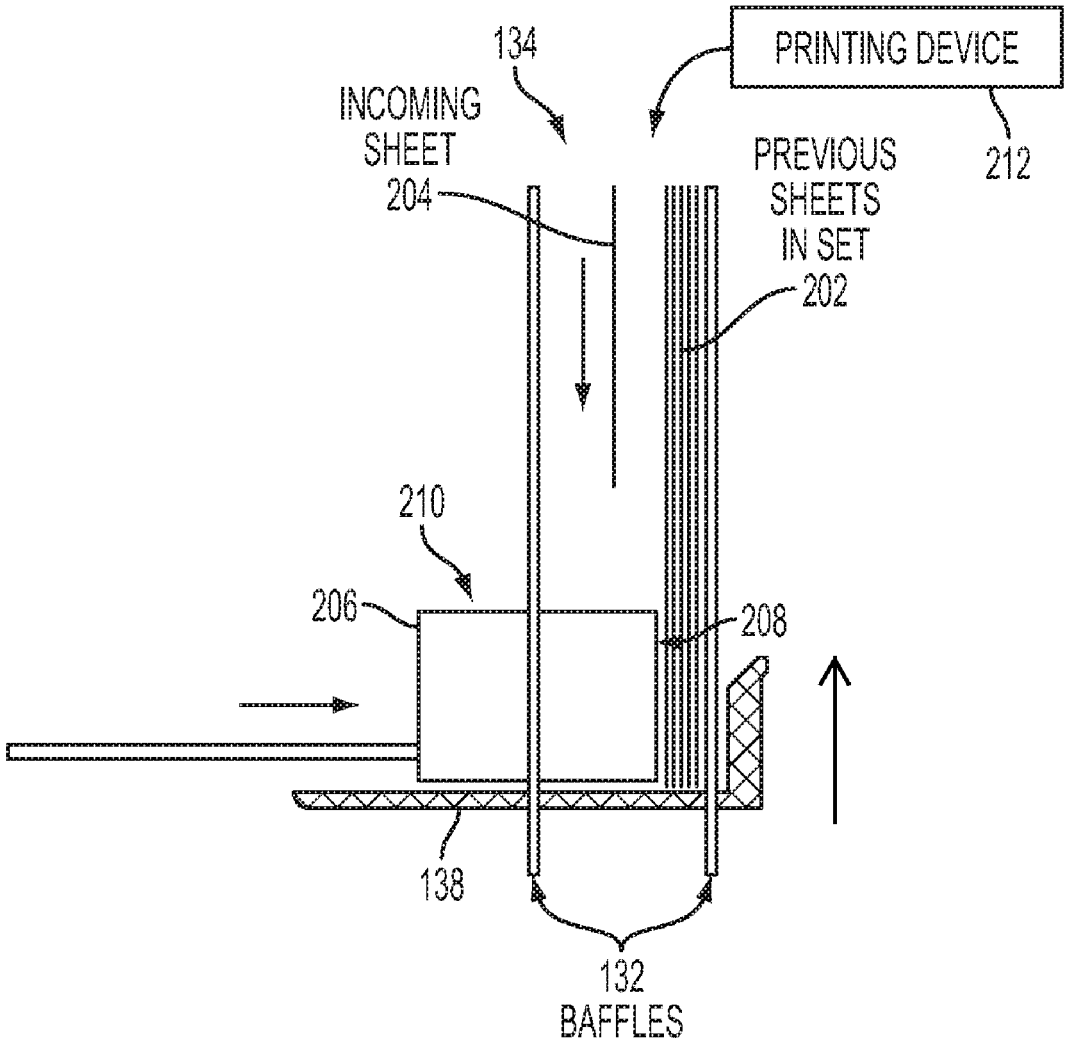
FIG. 2 is a schematic side view representation of a compile chamber.

As shown in FIG. 2, one feature of embodiments herein is that the movable projection 206 can be extended toward the media sheets (in the direction shown by the arrow in FIG. 2) such that the front surface 208 of the movable projection (that is approximately perpendicular to the upper surface 210 of the movable projection) applies pressure to approximately the full width of a lower portion of the media sheets. The movable projection has a width approximately at least as wide as the media sheet, and, therefore, the pressure is applied to substantially the full width of the lower portion of the media sheets. This prevents the media sheets from sagging within the chamber.

Figure 3:
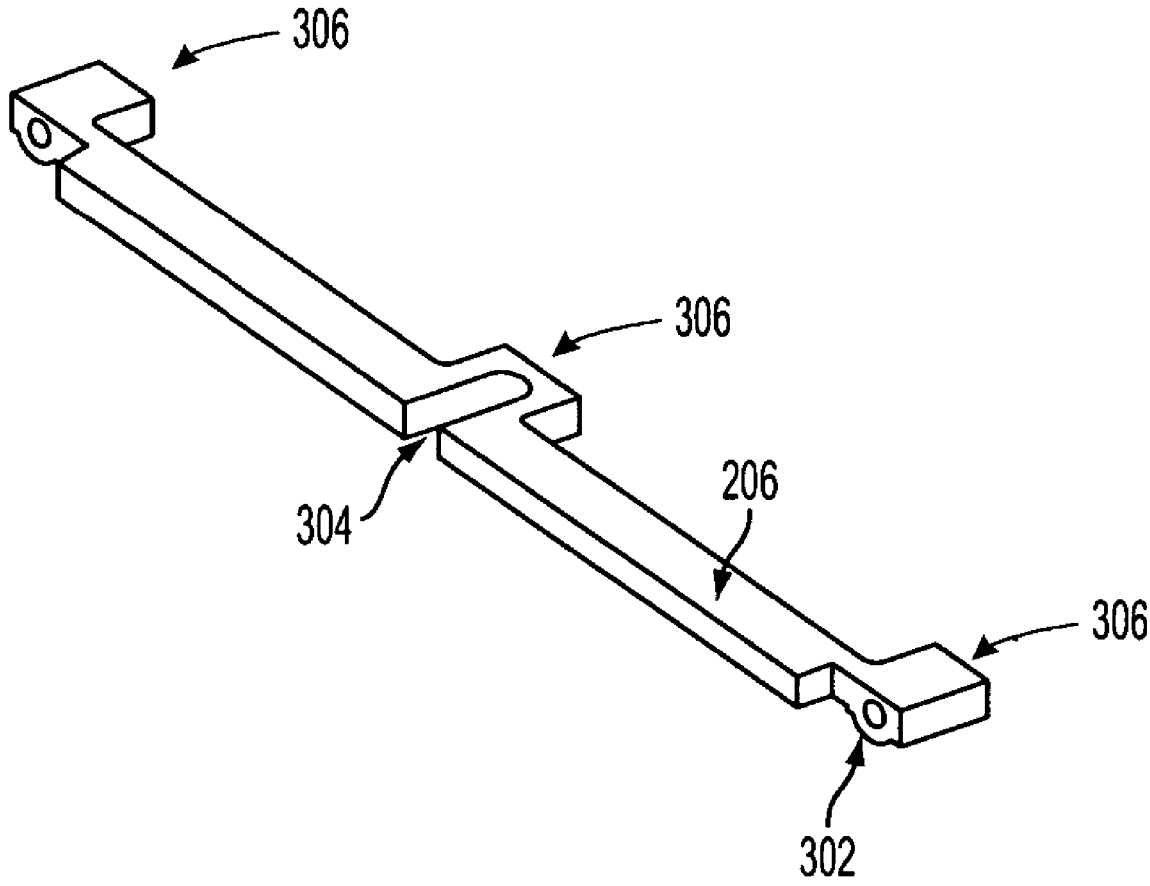
FIG. 3 is a schematic perspective view representation of a movable projection.
Figure 4:
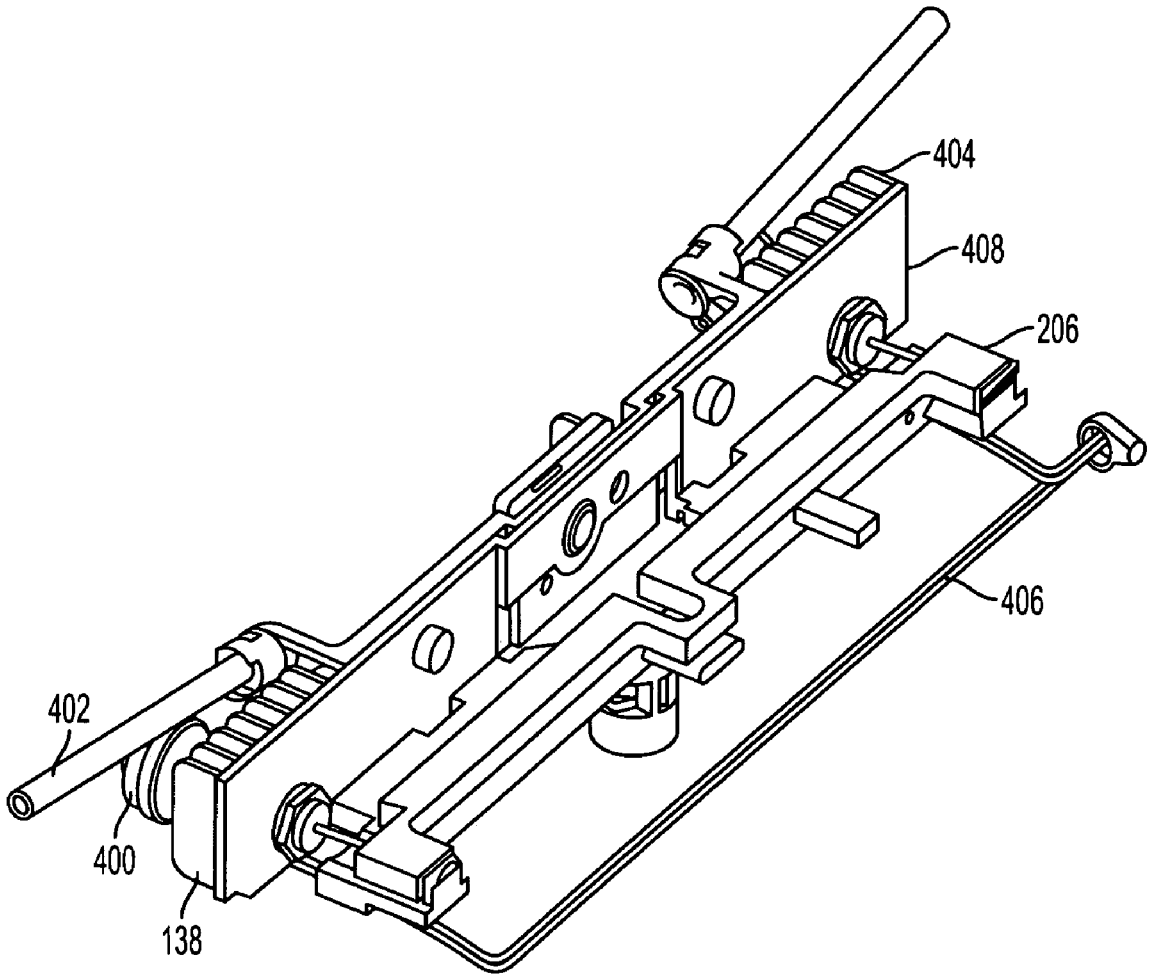
FIG. 4 is a schematic perspective view representation of an actuator and movable projection assembly.

In one embodiment (e.g., dual alignment process, discussed below) the clamp (movable projection) does not allow previously compiled sheets to move when it is engaged during tamping. In this embodiment, the movable projection eliminates the pressure on the baffle from the previous set when tamping the next sheet. In another embodiment, the movable projection 208 only exerts enough pressure to reduce most of the sag, without tightly clamping the sheets, so that the sheets can still move with respect to one another when being tamped. The movable projection has sufficient surface area (and pressure) to eliminate the sagging shown in FIG. 1B. The exact surface area shape of the movable projection and amount of pressure applied by the moveable projection will depend on the specific application and is easily determined by a set up procedure whereby various pressures and shapes are tested to remove sag. While the movable projection 208 comprises a rectangular box in the embodiment shown in FIG. 2, the movable projection 208 can take on any appropriate shape for a given application so long as it supplies pressure along a substantial portion (e.g., above 10%, above 20%, above 40%, above 60%, above 80%, etc.) of the width of the media sheets. For example, as shown in FIG. 3, the movable projection 206 can include a gap 304, finger projections 306 that make contact with the media sheets, and mounting points 302 that allow the movable projection 206 to fit with other devices of the finishing apparatus. Those devices can include, for example, (as shown in FIG. 4) a frame 408 having cooling fins 404 and support members 402. FIG. 4 also illustrate a solenoids 400 electrical connections 406 as well as the bottom 138 of the compile chamber 134.

The pressure of the movable projection 206 against the lower portion (e.g., lower half, lower third, lower quarter, etc.) of the media sheets 130 causes flat sides of the media sheets 130 to lie flatter against one of the sidewalls (the back sidewall, as shown in FIG. 2) when compared to a position of the sheets 130 with respect to the sidewalls without the pressure (as shown in FIG. 1B). These alignment processes are repeated for additional media sheets 130 sequentially placed into the chamber 134 to maintain proper alignment of all the sheets 130 within the chamber 134. Then, the properly aligned sheets 130 can be bound, perforated, stapled, or otherwise subjected to post-printing finishing processes.

One example of an apparatus useful with embodiments herein comprises a printing device 212 (marking engine, image output terminal, etc.) adjacent the chamber 134. As would be understood by one ordinary skill in the art after reading this disclosure, the compile chamber 134 could be attached to or used within a printer or printing device. The printing device 212 is adapted to output the media sheets 130 into the chamber 134. For example, the printing device comprises at least one of an electrostatographic and a Xerographic machine.

As stated above, the chamber 134 itself has a bottom 138 and sidewalls and, is adapted to receive and hold media sheets 130. The alignment mechanism 102, 104 is above the bottom 138 of the chamber 134 and aligns the media sheets 130 within the chamber 134. The alignment mechanism 102, 104 operates between the sidewalls (baffles) 132 and is adapted to contact edges of the media sheets 130 to align a stack of the media sheets 130 within the chamber 134. The movable projection 206 is also adapted to move through openings in the front baffle and move within a lower portion (e.g., lower half, lower third, lower quarter, etc.) of the chamber 134 so as to apply pressure to the previously compiled sheets 130 (FIG. 2) and prevent the sag shown in FIG. 1B and also prevent the friction 106 and torque 108 shown in FIG. 1A.

In some embodiments, the movable projection 206 can be retracted (partially or fully) from the compile chamber 134 before a new media sheet 204 is directed into the compile chamber 134. Then, after the newly inserted sheet 204 is resting on the bottom 138 of the compile chamber 134, the solenoids 400 operates to move the movable projection 206 against the stack of sheets 202 to remove the sag shown in FIG. 1B. In other embodiments, the movable projection 206 is not retracted before a new media sheet 204 is directed into the compile chamber 134. In these embodiments, a two-stage alignment process is utilized. More specifically, in the two-stage alignment process, the newly added sheet 204 comes in on top of the movable projection (plunger) 206 and the newly added sheet 204 is then tamped to the center. The movable projection is retracted to allow the newly added sheet 204 to drop down onto the performed for the newly added sheet 202 and the stack of sheets 204 to increase the accuracy of the alignment of the two together. In yet another embodiment, the bottom 138 can be raised up during the second alignment process in order to achieve a better tamping position and also to help straighten the sheet out if any twisting has occurred during the previous tamp and flap cycles.

Figure 5:
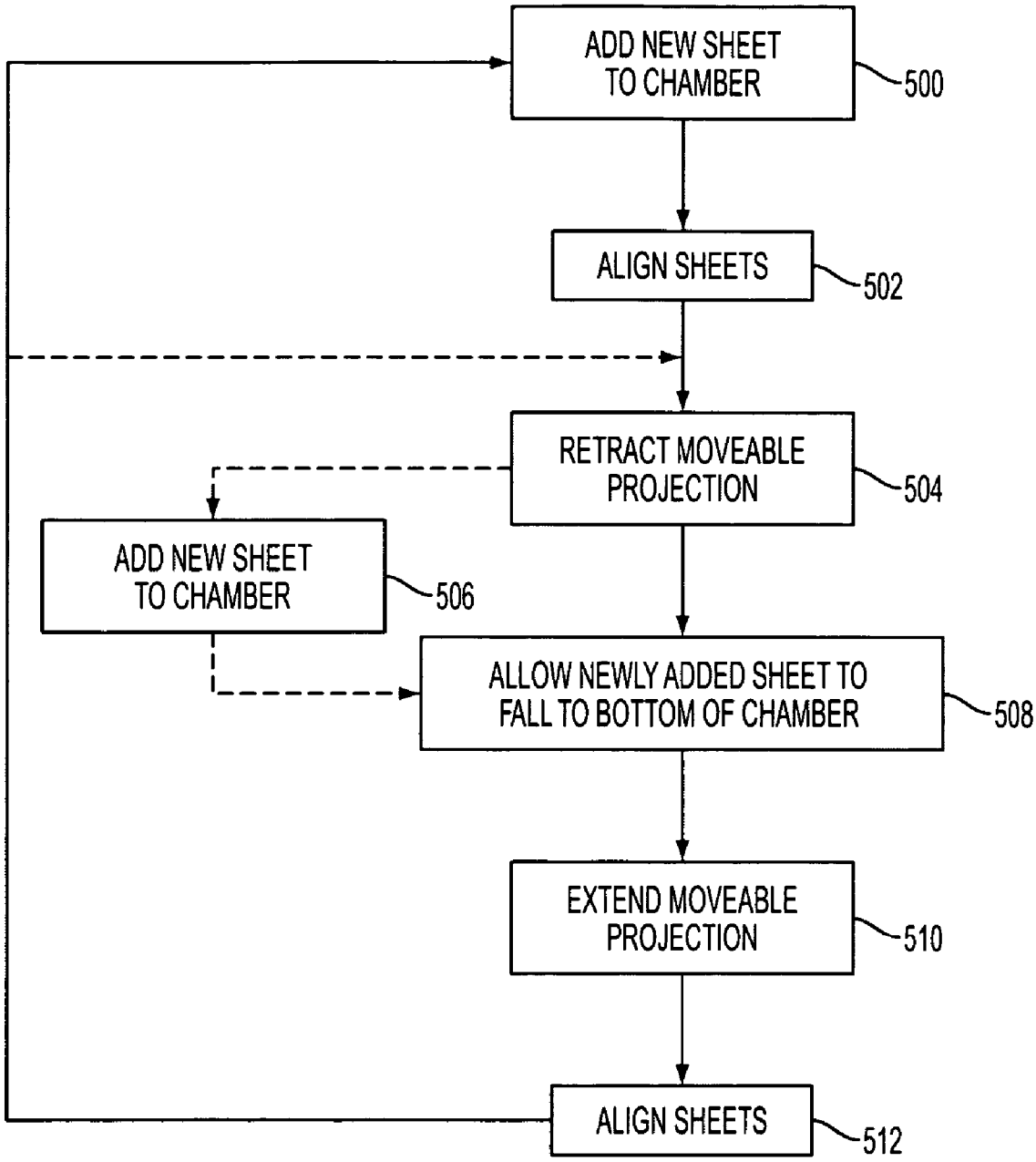
FIG. 5 is a flow chart illustrating one exemplary methodology according to embodiments herein.

Some of these process flows are illustrated in flowchart form in FIG. 5. In items 500, a new sheet is added to the chamber. The method can optionally perform a first alignment process 502 (using the alignment mechanism 102, 104) while the media sheet rests on the upper surface of the movable projection 206. Thus, the upper surface 210 of the movable projection 206 is adapted to support at least a first media sheet above the bottom 138 of the chamber 134 to allow the alignment mechanism 102, 104 to align the first media sheet with others of the media sheets 130 in the chamber 134. Then, in item 504 the method can retract the movable projection 206 to allow the media sheet to fall onto (rest against) the bottom 138 of the chamber 134 as shown in item 508. Alternatively, if the two-stage alignment process is not used, the new sheet would be added to the chamber in item 506 after retracting the movable projection in item 504. In FIG. 5, the single-stage processing utilizes the flow shown by the dashed lines.

Next, once the media sheet rests against the bottom 138 of the chamber 134, the movable projection is extended against the stack of sheets 130 as shown in items 510. Then, the method performs a second alignment process in item 512, again using the alignment mechanism 102, 104. Depending upon whether the two-stage of alignment process is being utilized, processing either returns to items 500 (for the two-stage alignment processing) or returns to items 504 to allow the movable projection be retracted back from the stack of sheets 130 to allow the newly added sheet to fall directly to the bottom 138 of the chamber as it is being added to the chamber in item 508. These processes are repeated until the stack of sheets 130 is complete and can be removed from the compile chamber 134.

During the first alignment process 502 and the second alignment process 512, the alignment mechanism operates between the sidewalls and contacts edges of the media sheets 130 to align a stack of the media sheets 130 within the chamber 134. During the second alignment process 512, the method can move the bottom 138 of the chamber 134 toward the top of the chamber 134 so as to move a bottom edge of the media sheets 130 to at least the height of the upper surface 210 of the movable projection 206. This allows the alignment mechanism to place pressure against the same portions of the media sheets 130 both when the media rests on the movable projection 206 and when the media rests on the bottom 138 of the chamber 134, and thereby does not require alteration of standard alignment mechanisms 102, 104.

The word "printer" as used herein encompasses any apparatus, such as a digital copier, bookmaking machine, facsimile machine, multi-function machine, etc. which performs a print outputting function for any purpose. The details of printers, printing engines, etc. are well-known by those ordinarily skilled in the art and are discussed in, for example, U.S. Pat. No. 6,032,004, the complete disclosure of which is fully incorporated herein by reference. The following claims can encompass embodiments that print in monochrome of color, or handle color image data. All foregoing embodiments are specifically applicable to electrostatographic and/or xerographic machines and/or processes.

The movable projection forces the previously compiled sheets to straighten up and reduces the friction against the compile chamber to allow the incoming single sheet to be more easily tamped. By utilizing the full-width movable projection to reduce the amount of sag within the compile chamber, the embodiments herein allow the media sheets to be more easily aligned by the tamping alignment mechanism. Further, by utilizing a two-step alignment process, the tamping alignment mechanism is provided the opportunity to both individually align a newly added sheet with the previously aligned sheets and to subsequently align all sheets within the compile chamber. Thus, this two-step alignment process greatly increases the ability of the alignment device to properly align the media sheets.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An apparatus comprising:

a chamber comprising a bottom and sidewalls, wherein said chamber is adapted to hold media sheets;

an alignment mechanism above said bottom of said chamber, wherein said alignment mechanism is adapted to align said media sheets within said chamber; and a movable projection within a lower portion of said chamber, wherein said movable projection comprises:

a front surface having a size and shape to apply pressure to a lower portion of said media sheets; and an upper surface approximately perpendicular to said front surface, wherein said upper surface has a size and shape to support at least a first media sheet of said media sheets at a height above said bottom of said chamber, wherein said size and shape of said upper surface allows said alignment mechanism to align said first media sheet with others of said media sheets in said chamber while said first media sheet rests on said upper surface of said movable projection.

2. The apparatus according to claim 1, wherein said bottom of said chamber is adapted to move toward a top of said chamber so as to move a bottom edge of said media sheets to at least a height of an upper surface of said movable projection.

3. The apparatus according to claim 1, wherein, when said movable projection applies said pressure to said lower portion of said media sheets, said pressure causes flat sides of said media sheets to lie flatter against one of said sidewalls when compared to a position of said sheets with respect to said sidewalls without said pressure.

4. The apparatus according to claim 1, wherein said alignment mechanism operates between said sidewalls and is adapted to contact edges of said media sheets to align a stack of said media sheets within said chamber.

5. The apparatus according to claim 1, further comprising a printing device adjacent said chamber, wherein said printing device is adapted to output said media sheets into said chamber, and wherein said printing device comprises at least one of an electrostatographic and a xerographic machine.

6. An apparatus comprising:

a chamber comprising a bottom and sidewalls, wherein said chamber is adapted to hold media sheets;

an alignment mechanism above said bottom of said chamber, wherein said alignment mechanism is adapted to align said media sheets within said chamber; and a movable projection within a lower portion of said chamber, wherein said movable projection comprises:

a front surface having a size and shape to apply pressure to a lower portion of said media sheets, wherein said front surface of said movable projection has a width approximately at least as wide as said media sheets; and an upper surface approximately perpendicular to said front surface, wherein said upper surface has a size and shape to support at least a first media sheet of said media sheets at a height above said bottom of said chamber, wherein said size and shape of said upper surface allows said alignment mechanism to align said first media sheet with others of said media sheets in said chamber while said first media sheet rests on said upper surface of said movable projection.

7. The apparatus according to claim 6, wherein said bottom of said chamber is adapted to move toward a top of said chamber so as to move a bottom edge of said media sheets to at least a height of said upper surface of said movable projection.

8. The apparatus according to claim 6, wherein, when said front surface of said movable projection applies said pressure to said lower portion of said media sheets, said pressure causes flat sides of said media sheets to lie flatter against one of said sidewalls when compared to a position of said sheets with respect to said sidewalls without said pressure.

9. The apparatus according to claim 6, wherein said alignment mechanism operates between said sidewalls and is adapted to contact edges of said media sheets to align a stack of said media sheets within said chamber.

10. The apparatus according to claim 6, further comprising a printing device adjacent said chamber, wherein said printing device is adapted to output said media sheets into said chamber, and wherein said printing device comprises at least one of an electrostatographic and a xerographic machine.

11. A method comprising:

placing media sheets into a chamber comprising a bottom and sidewalls and a movable projection within a lower portion of said chamber, wherein said movable projection comprises an upper surface and said media sheet initially rests on said upper surface of said movable projection;

performing a first alignment process using an alignment mechanism while said media sheet rests on said upper surface of said movable projection;

retracting said movable projection to allow said media sheet to rest against said bottom of said chamber;

applying pressure to a lower portion of said media sheets using said movable projection; and performing a second alignment process within said chamber using said alignment mechanism while said media sheet rests on said bottom of said chamber.

12. The method according to claim 11, further comprising moving said bottom of said chamber toward a top of said chamber so as to move a bottom edge of said media sheets to at least a height of an upper surface of said movable projection.

13. The method according to claim 11, wherein said applying of said pressure causes flat sides of said media sheets to lie flatter against one of said sidewalls when compared to a position of said sheets with respect to said sidewalls without said pressure.

14. The method according to claim 11, wherein during said said first alignment process and said second alignment process, said alignment mechanism operates between said sidewalls and contacts edges of said media sheets to align a stack of said media sheets within said chamber.

15. The method according to claim 11, further comprising operating a printing device adjacent said chamber, to cause said printing device to output said media sheets into said chamber, and wherein said printing device comprises at least one of an electrostatographic and a xerographic machine.

16. A method comprising:

placing a media sheet into a chamber, wherein said chamber comprises a bottom, sidewalls, and a movable projection within a lower portion of said chamber, wherein said movable projection comprises an upper surface and said media sheet initially rests on said upper surface of said movable projection;

performing a first alignment process using an alignment mechanism while said media sheet rests on said upper surface of said movable projection;

retracting said movable projection to allow said media sheet to rest against said bottom of said chamber;

performing a second alignment process using said alignment mechanism while said media sheet rests on said bottom of said chamber;

extending said movable projection toward said media sheets such that a front surface of said movable projection, that is approximately perpendicular to said upper surface of said movable projection, applies pressure to a full width of a lower portion of said media sheets, wherein said movable projection has a width approximately at least as wide as said media sheet, such that said pressure is applied to said full width of said lower portion of said media sheets; and repeating said first alignment process, said retracting, said second alignment process, and said extending for additional media sheets sequentially placed into said chamber.

17. The method according to claim 16, further comprising, during said second alignment process, moving said bottom of said chamber toward a top of said chamber so as to move a bottom edge of said media sheets to at least a height of an upper surface of said movable projection.

18. The method according to claim 16, wherein said pressure causes flat sides of said media sheets to lie flatter against one of said sidewalls when compared to a position of said sheets with respect to said sidewalls without said pressure.

19. The method according to claim 16, wherein during said first alignment process and said second alignment process, said alignment mechanism operates between said sidewalls and contacts edges of said media sheets to align a stack of said media sheets within said chamber.

20. The method according to claim 16, further comprising operating a printing device adjacent said chamber, to cause said printing device to output said media sheets into said chamber, and wherein said printing device comprises at least one of an electrostatographic and a xerographic machine.

* * * * *